US008278018B2

(12) United States Patent
Proper et al.

(10) Patent No.: US 8,278,018 B2
(45) Date of Patent: Oct. 2, 2012

(54) PROCESS FOR PRODUCING DRY INK COLORANTS THAT WILL REDUCE METAMERISM

(75) Inventors: James M. Proper, Webster, NY (US); Scott Silence, Fairport, NY (US); Rick Veregin, Mississauga (CA); Daryl Walter Vanbesien, Burlington (CA); Eric Strohm, Oakville (CA); Raj Patel, Oakville (CA); Maria McDougall, Oakville (CA)

(73) Assignee: Xerox Corporation, Norwalk, CT (US)

( * ) Notice: Subject to any disclaimer, the term of this patent is extended or adjusted under 35 U.S.C. 154(b) by 1081 days.

(21) Appl. No.: 11/685,868

(22) Filed: Mar. 14, 2007

(65) Prior Publication Data

US 2008/0232848 A1 Sep. 25, 2008

(51) Int. Cl.
*G03G 13/00* (2006.01)

(52) U.S. Cl. ..... 430/137.1; 399/54; 399/57; 399/59; 399/223

(58) Field of Classification Search ..... 430/137.1; 399/54, 57, 59, 223
See application file for complete search history.

(56) References Cited

U.S. PATENT DOCUMENTS

| | | | |
|---|---|---|---|
| 2,470,001 | A | 5/1949 | Stober |
| 3,590,000 | A | 6/1971 | Palermiti et al. |
| 3,655,374 | A | 4/1972 | Palermiti et al. |
| 3,720,617 | A | 3/1973 | Chatterji et al. |
| 3,944,493 | A | 3/1976 | Jadwin et al. |
| 3,983,045 | A | 9/1976 | Jugle et al. |
| 4,007,293 | A | 2/1977 | Mincer et al. |
| 4,079,014 | A | 3/1978 | Burness et al. |
| 4,222,982 | A | 9/1980 | Beatty et al. |
| 4,233,388 | A | 11/1980 | Bergen et al. |
| 4,298,672 | A | 11/1981 | Lu |
| 4,394,430 | A | 7/1983 | Jadwin et al. |
| 4,560,635 | A | 12/1985 | Hoffend et al. |
| 4,935,326 | A | 6/1990 | Creatura et al. |
| 4,937,166 | A | 6/1990 | Creatura et al. |
| 5,278,020 | A | 1/1994 | Grushkin et al. |
| 5,290,654 | A | 3/1994 | Sacripante et al. |
| 5,308,734 | A | 5/1994 | Sacripante et al. |
| 5,344,738 | A | 9/1994 | Kmiecik-Lawrynowicz et al. |
| 5,346,797 | A | 9/1994 | Kmiecik-Lawrynowicz et al. |
| 5,348,832 | A | 9/1994 | Sacripante et al. |
| 5,364,729 | A | 11/1994 | Kmiecik-Lawrynowicz et al. |
| 5,366,841 | A | 11/1994 | Patel et al. |
| 5,370,963 | A | 12/1994 | Patel et al. |
| 5,403,693 | A | 4/1995 | Patel et al. |
| 5,405,728 | A | 4/1995 | Hopper et al. |
| 5,418,108 | A | 5/1995 | Kmiecik-Lawrynowicz et al. |
| 5,496,676 | A | 3/1996 | Croucher et al. |

(Continued)

FOREIGN PATENT DOCUMENTS

CA 1183033 2/1985

*Primary Examiner* — Peter Vajda
(74) *Attorney, Agent, or Firm* — MH2 Technology Law Group LLP

(57) ABSTRACT

In accordance with the invention, there is a method of forming a toner. The method can include blending two or more colorants to form a sample toner and forming a sample color specimen including a printed image comprising the sample toner. The method can further include comparing spectral distribution curves of the sample color specimen with that of a target color specimen including a target color and repeating the disclosed steps until acquiring a desired spectral match between the sample toner and the target color.

24 Claims, 4 Drawing Sheets

U.S. PATENT DOCUMENTS 5,501,935 A 3/1996 Patel et al.
5,527,658 A 6/1996 Hopper et al.
5,585,215 A 12/1996 Ong et al.
5,650,255 A 7/1997 Ng et al.
5,650,256 A 7/1997 Veregin et al.
5,723,253 A 3/1998 Higashino et al.
5,744,520 A 4/1998 Kmiecik-Lawrynowicz et al.
5,747,215 A 5/1998 Ong et al.
5,763,133 A 6/1998 Ong et al.
5,766,818 A 6/1998 Smith et al.
5,804,349 A 9/1998 Ong et al.
5,827,633 A 10/1998 Ong et al.
5,840,462 A 11/1998 Foucher et al.
5,853,944 A 12/1998 Foucher et al.
5,863,698 A 1/1999 Patel et al.
5,869,215 A 2/1999 Ong et al.
5,899,605 A * 5/1999 Caruthers et al. ..... 399/223
5,902,710 A 5/1999 Ong et al.
5,910,387 A 6/1999 Mychajlowskij et al.
5,916,725 A 6/1999 Patel et al.
5,919,595 A 7/1999 Mychajlowskij et al.
5,925,488 A 7/1999 Patel et al.
5,977,210 A 11/1999 Patel et al.
5,994,020 A 11/1999 Patel et al.
6,004,714 A 12/1999 Ciccarelli et al.
6,020,101 A 2/2000 Sacripante et al.
6,120,967 A 9/2000 Hopper et al.
6,130,021 A 10/2000 Patel et al.
6,190,815 B1 2/2001 Ciccarelli et al.
6,480,299 B1 * 11/2002 Drakopoulos et al. ..... 358/1.9
6,628,102 B2 9/2003 Batson
2004/0085326 A1 * 5/2004 Agar ..... 345/589
2005/0018226 A1 * 1/2005 Chiba ..... 358/1.9
2006/0210295 A1 * 9/2006 Nakaya et al. ..... 399/75
2007/0048020 A1 * 3/2007 Silence ..... 399/223

* cited by examiner

PROCESS FOR PRODUCING DRY INK COLORANTS THAT WILL REDUCE METAMERISM

FIELD OF THE INVENTION

The subject matter of this invention relates to color toners. More particularly, the subject matter of this invention relates to methods of reducing metamerism by developing dry ink colorants for color toners.

BACKGROUND OF THE INVENTION

Metamerism occurs when two materials do not match in color under all lighting conditions. This means that a solid color patch, when viewed under two different light sources, appears to cast two different colors, as shown in FIG. 3. The technical definition for metamerism is a conditional match, such that, two or more samples match for one observer under one light source, but not under a different light source for that same observer. Modern color reproduction techniques that use RGB or CMYK primaries take advantage of metamerism for making calorimetric reproductions of an original. A calorimetric reproduction is one in which both the original and reproduction have the same CIE XYZ tristimulus values. These processes allow color matches to be made under one lighting condition when the reproduction will be made from different materials (color primaries) than the original. Although calorimetric or metameric reproduction techniques are very useful, they may not always be satisfying to all users. For instance, some manufacturers of certain products rely on the color of their product to attract potential buyers. These manufacturers would obviously want the color of their product to look the same whether it was being sold under fluorescent lighting such as in a supermarket, or under sunlight such as at an outside sidewalk stand, otherwise the potential buyers may not recognize the product.

Thus, there is a need to overcome these and other problems of the prior art to provide methods of reducing metamerism.

SUMMARY OF THE INVENTION

In accordance with the invention, there is a method of forming a toner. The method can include blending two or more colorants to form a sample toner and forming a sample color specimen including a printed image including the sample toner. The method can further include comparing spectral distribution curves of the sample color specimen with that of a target color specimen including a target color and repeating the disclosed steps until acquiring a desired spectral match between the sample toner and the target color.

According to another embodiment of the present teachings, there is a method of forming an image. The method can include providing an imaging station for forming a latent image on an electrophotographic photoreceptor, providing a development subsystem including a set of toners for converting the latent image to a visible image on the electrophotographic photoreceptor, and providing a transfer station for transferring and fixing the visible image onto a media, wherein one or more toners has a spectral match to one or more desired target colors.

According to yet another embodiment of the present teachings, there is a printing machine including a developer housing and a latent image receiving member adapted for developing a set of toners to form color images, and wherein one or more toners has a spectral match to one or more desired target colors.

Additional advantages of the embodiments will be set forth in part in the description which follows, and in part will be obvious from the description, or may be learned by practice of the invention. The advantages will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate embodiments of the invention and together with the description, serve to explain the principles of the invention.

DESCRIPTION OF THE EMBODIMENTS

Reference will now be made in detail to the present embodiments, examples of which are illustrated in the accompanying drawings. Wherever possible, the same reference numbers will be used throughout the drawings to refer to the same or like parts.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less that 10" can assume negative values, e.g. −1, −2, −3, −10, −20, −30, etc.

Figure 1:
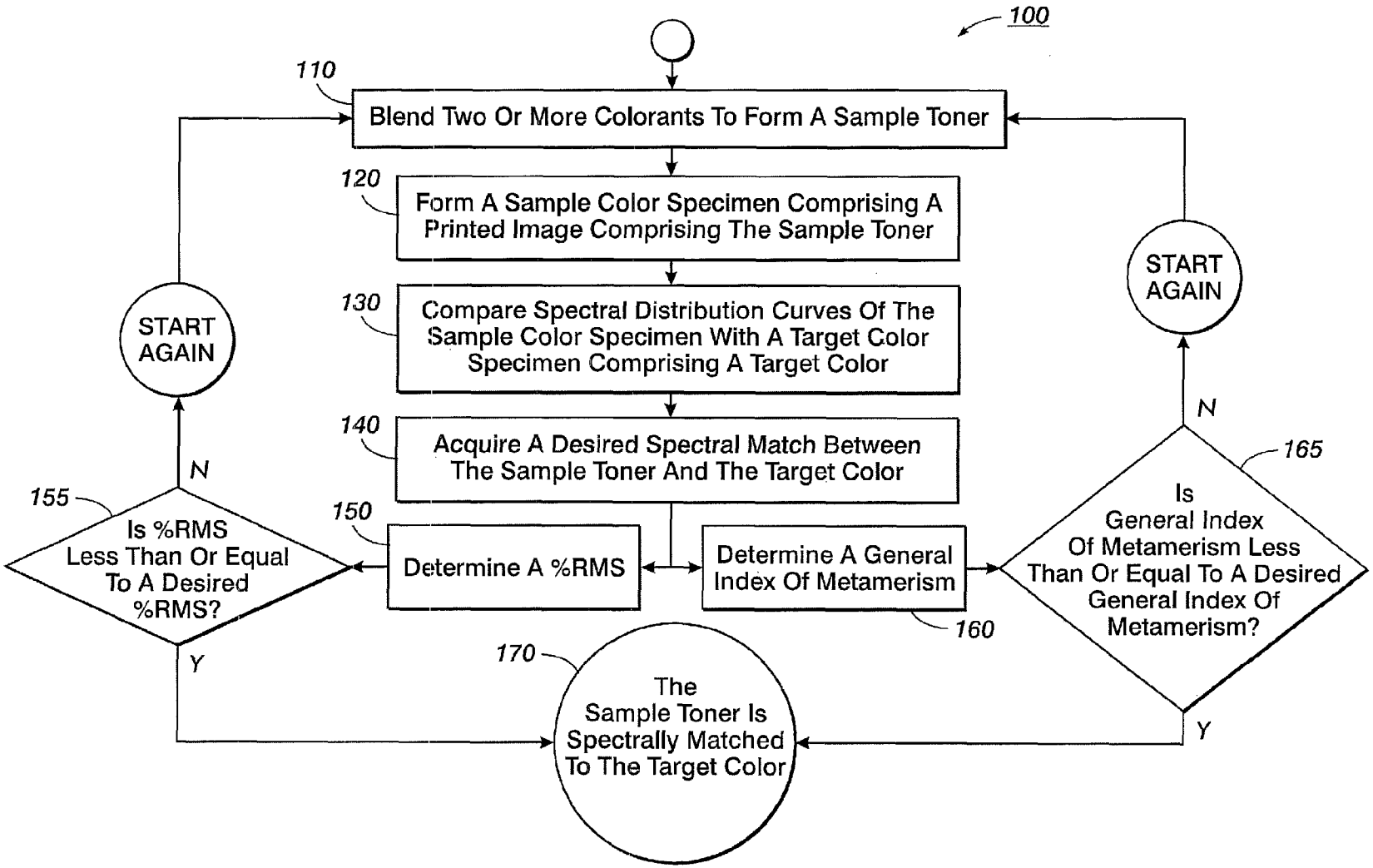
FIG. 1 depicts a flow chart of an exemplary method of forming a toner, according to various embodiments of the present teachings.

According to various embodiments of the present teachings, there is a method of forming a toner as shown in FIG. 1. The method 100 as shown in FIG. 1 can include blending two or more colorants to form a sample toner as in 110 and forming a sample color specimen including a printed image including the sample toner as shown in 120. In various embodiments, the step 110 of blending two or more colorants to form a sample toner can include blending two or more primary toners. In various embodiments, the colorants can include one or more of pigments, dyes, mixture of pigments and dyes, mixture of pigments, mixture of dyes, and the like. In some embodiments, the step of forming a sample color specimen including a printed image including the sample toner can include fusing the sample toner onto a white substrate.

As used herein, the term "primary color" is a color that cannot be created by mixing other colors in the gamut of a given color space. Furthermore, primary colors may themselves be mixed to produce most of the colors in a given color space: mixing two primary colors produces what is generally called a secondary color. Also, if two or primary pigments are mixed together the result will not be another independent primary colorant. However, if another ingredient is added to the mixture of two or more primary colorants that will change the spectral distribution of the mixture such that it is no longer statistically dependent on the colorants then the new colorant can also be considered a primary colorant. However, when making mixtures of toner primaries, such as CMYK, the color of secondary toners result from the mixture of the primary toners.

The method 100 of forming a toner as shown in FIG. 1 can further include comparing spectral distribution curves of the sample color specimen with that of a target color specimen including a target color as shown in 130 and repeating the disclosed steps until acquiring a desired spectral match between the sample toner and the target color as shown in 140.

In various embodiments, the target color specimen can include one or more colorants of an offset printing, a lithography, a flexography, inkjet, and dry ink xerographic processes as well. In some embodiments, the target color specimen can include a Pantone color standard including one or more Pantone primary colorants. In some other embodiments, the target color specimen can include at least one of Pantone offset ink primaries: Pantone Yellow, Warm Red, Rubin Red, Rhodamine Red, Purple, Violet, Reflex Blue, Process Blue, Green, Yellow 012, Orange 021, Red 032, Blue 72, and Black. In various embodiments, the toner can include at least one of Yellow, Orange, Warm Red, Red 032, Rubin Red, Rhodamine Red, Purple, Violet, Blue 72, Reflex Blue, Process Blue, and Green toner.

In various embodiments, the step of acquiring a desired spectral match between the sample toner and the target color as in 140 can include determining a desired % root mean square difference in the spectral distribution curves of the sample color specimen and the target color specimen as in 150, 155 as shown in FIG. 1. The spectral distribution curves, such as spectral reflectance curves of the sample color specimen and the target color specimen can be determined by measurements using a spectrophotometer, made by various companies such as, for example X-Rite Inc. and GretagMacbeth AG. In some embodiments, the desired % root mean square difference in the spectral distribution curves of a sample color specimen and the target color specimen can be less than or equal to about 12% and preferably be less than or equal to about 6%. In some other embodiments, the desired % root mean square difference in the spectral distribution curves of a sample color specimen and the target color specimen can be less than or equal to about 2%. Table 1 shows the % root mean square difference in the spectral distribution curves of exemplary sample color specimens and exemplary target color specimens, wherein the sample color specimens include experimentally developed primary toners and the target color specimens include the Pantone ink primaries.

TABLE 1

| Sample Color Specimen | Target color Specimen | % RMS | $\Delta E_{00}$ | GMI |
|---|---|---|---|---|
| Yellow | Yellow | 1.41 | 0.60 | 0.63 |
| Orange | Orange 021 | 1.31 | 0.40 | 0.34 |

TABLE 1-continued

| Sample Color Specimen | Target color Specimen | % RMS | $\Delta E_{00}$ | GMI |
|---|---|---|---|---|
| WR | Warm Red | 3.07 | 2.66 | 1.47 |
| Red 032 | Red 032 | 3.15 | 2.32 | 1.17 |
| Rub Red | Rubine Red | 3.01 | 1.32 | 0.88 |
| Rho Red | Rhodamine red | 6.88 | 2.68 | 2.78 |
| Purple | Purple | 9.76 | 3.17 | 3.18 |
| Violet | Violet | 11.94 | 3.41 | 2.11 |
| Blue 072 | Blue 072 | 6.16 | 16.61 | 2.97 |
| Reflex Blue | Reflex Blue | 7.04 | 12.57 | 3.97 |
| Proc Blue | Process Blue | 2.94 | 2.56 | 0.77 |
| Green | Green | 2.49 | 2.62 | 1.10 |
| Black | Black | 2.30 | 8.64 | 1.07 |
| Paper | Paper | 9.47 | 3.04 | 3.11 |
| Average | | 5.07 | 4.47 | 1.83 |
| Maximum | | 11.94 | 16.61 | 3.97 |
| Minimum | | 1.31 | 0.40 | 0.34 |

Figure 4:
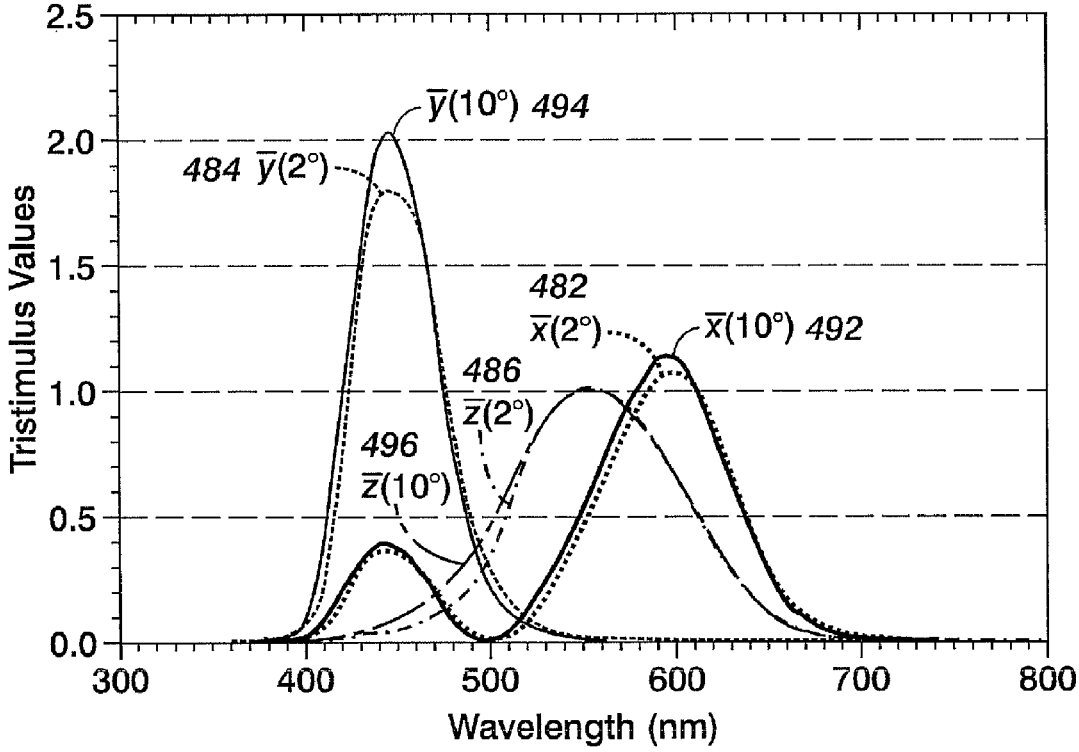
FIG. 4 shows color matching functions for a CIE 1931 2° and a CIE 1964 10° standard calorimetric observer.

In some embodiments, the spectral distribution curves data values can be convoluted and integrated with the data table values of the CIE illuminant, such as, for example D50, and the 2° standard observer functions to obtain CIE tristimulus values X, Y, Z. The X, Y, Z tristimulus values for a color with a spectral power distribution I(λ) can be given by:

$$X = \int_0^\infty I(\lambda)\bar{x}(\lambda)d\lambda \tag{1}$$

$$Y = \int_0^\infty I(\lambda)\bar{y}(\lambda)d\lambda \tag{2}$$

$$Z = \int_0^\infty I(\lambda)z(\lambda)d\lambda \tag{3}$$

where $\bar{x}(\lambda)$ 482, 492, $\bar{y}(\lambda)$, 484, 494, and $\bar{z}(\lambda)$ 486, 496 are the color matching functions as shown in FIG. 4 for a CIE 1931 2° and a CIE 1964 10° standard calorimetric observer.

However, the CIEXYZ tristimulus values of X, Y and Z do not offer information about lightness, hue and saturation, therefore, they can be transformed into other color systems, such as CIELAB values, L*, a*, and b*. The CIELAB space is widely used in the imaging industry for reflection prints. The parameter L* in the CIELAB space indicates the lightness of the color (L*=0 indicates black and L*=100 indicates white), a* indicates the color's position between red and green (negative values of a* represents greenness of a color while positive values represents redness of a color) and b* indicates the color's position between yellow and blue (negative values of b* represents blueness of a color while positive values indicate yellowness of a color). The range of a* and b* is generally between −128 and 127. The chroma of a color in CIELAB space can be determined by calculating the distance to the color from the L* axis and within the a*-b* plane containing the color defined by a unique set of a*, b*, and L* coordinates. The hue of a particular color can be determined by calculating the angle that the a*-b* coordinates make with the a* axis. The CILELAB values L*, a*, b* can be obtained from the CIEXYZ tristimulus values as shown below:

$$L^* = 116f\left(\frac{Y}{Y_n}\right) - 16 \tag{4}$$

$$a^* = 500\left[f\left(\frac{X}{X_n}\right) - f\left(\frac{Y}{Y_n}\right)\right] \tag{5}$$

-continued $$b^* = 200\left[f\left(\frac{Y}{Y_n}\right) - f\left(\frac{Z}{Z_n}\right)\right] \quad (6)$$

where $$f(x) = x^{1/3} \quad \text{for } x > 0.008856$$

$$f(x) = 7.787x + \frac{16}{116} \quad \text{for } x \le 0.008856$$

$X_n$, $Y_n$, and $Z_n$ are the CIE XYZ tristimulus values of a reference white point or a specified white object.

Furthermore, ΔE, color difference value between a sample color specimen and a target color specimen can be calculated from the CIELAB values of the sample color specimen and the target color specimen as follows:

$$\Delta E = \sqrt{(\Delta L^*)^2 + (\Delta a^*)^2 + (\Delta b^*)^2} \quad (7)$$

where $\Delta L = L^*_{sample} - L^*_{target}$ $\Delta a^* = a^*_{sample} - a^*_{target}$ $\Delta b^* = b^*_{sample} - b^*_{target}$ $L^*_{sample}$, $a^*_{sample}$, and $b^*_{sample}$ are the CIELAB values of the sample color specimen and $L^*_{target}$, $a^*_{target}$, and $b^*_{target}$ are the CIELAB values of the target color specimen.

In various embodiments, the step 140 of acquiring a desired spectral match between the sample color specimen and the standard color specimen can include determining a desired value of general index of metamerism in terms of color difference in the spectral distribution curves of the primary color specimen and the standard color specimen as in 160, 165 of FIG. 1. The general index of metamerism provides an indication of how well two materials, in this case a sample color specimen and a standard color specimen that match under a reference illuminant n1 will match under a test illuminant n2. Typically, CIE illuminant $D_{65}$ can be chosen as the reference illuminant n1 and the test illuminant n2 can be chosen depending on the end use of the material. General index of metamerism can be calculated as follows:

$$GMI = \sqrt{(\Delta L^*_{n1} - \Delta L^*_{n2})^2 + (\Delta a^*_{n1} - \Delta a^*_{n2})^2 + (\Delta b^*_{n1} - \Delta b^*_{n2})^2} \quad (8)$$

where $\Delta L = L^*_{sample} - L^*_{target}$ $\Delta a^* = a^*_{sample} - a^*_{target}$ $\Delta b^* = b^*_{sample} - b^*_{target}$ $L^*_{sample}$, $a^*_{sample}$, and $b^*_{sample}$ are the CIELAB values of the sample color specimen and $L^*_{target}$, $a^*_{target}$, and $b^*_{target}$ are the CIELAB values of the target color specimen.

In some embodiments, the reference illuminant n1 can include a CIE $D_{65}$ illuminant having a correlated color temperature of 6500 K. In other embodiments, the test illuminant n2 can include an Illuminant A similar to an incandescent light source and having a profile of a black body radiator at 28560 K. The two illuminants $D_{65}$ and A can be chosen as they will most likely result in the most variation in color. In various embodiments, the desired value of a general index of metamerism in terms of color difference in the spectral distribution curves of the sample color specimen and the target color specimen can be less than or equal to about 4. In other embodiments, the desired value of a general index of metamerism in terms of color difference in the spectral distribution curves of the primary color specimen and the target color specimen can be less than or equal to about 1.

Table 1 shows the general index of metamerism, GMI of exemplary sample color specimens and exemplary target color specimens under the illuminants $D_{65}$ and A, wherein the sample color specimens include experimentally developed primary toners and the target color specimens include the Pantone ink primaries. It should be noted in Table 1 that the average general index of metamerism, GMI is less than about $2\Delta E_{00}$ units and in some cases even less than about $1\Delta E_{00}$ units, which is a preferred range. One of ordinary skill in the art would know that the CIELAB space is not perfectly uniform relative to human perception, i.e. humans have different sensitivities in different areas of the CIELAB space. However, the $\Delta E_{00}$ color difference metric tries to take into account these differences. On average, a just noticeable difference (JND) in color will result in about $2\Delta E_0$ color difference units. Hence, on average, the sample color specimens including the primary toners listed in Table 1 match spectrally well with the target color specimens including the Pantone ink primaries.

As shown in FIG. 1, if the determined % RMS and determined GMI are less than or equal to the desired % RMS and desired GMI, then the sample toner can be spectrally matched to the target color as in 170 and if not, then all the steps 110, 120, 130, 140, 150, 155, 160, 165 can be repeated until a spectral match can be found as in 170, 270.

The method 100 of forming a toner including the step 110 of blending two or more colorants can further include selecting colorants from one or more of a yellow pigment, an orange pigment, a red pigment, a magenta pigment, a purple pigment, a blue pigment, a cyan pigment, a green pigment, and a black pigment. In various embodiments, the step 110 of blending two or more colorants to form a toner can also include adding one or more of resin, charge additives, and surface additives.

Toners of the present teachings can be prepared, for example, by conventional melt blending/extrusion or by emulsion/aggregation or any other in situ methodology.

Emulsion/aggregation/coalescence processes for the preparation of toners are illustrated in a number of Xerox patents, the disclosures of each of which are incorporated by reference herein in their entirety, such as U.S. Pat. No. 5,290,654, U.S. Pat. No. 5,278,020, U.S. Pat. No. 5,308,734, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797; U.S. Pat. Nos. 5,348,832; 5,405,728; 5,366,841; 5,496,676; 5,527,658; 5,585,215; 5,650,255; 5,650,256; 5,501,935; 5,723,253; 5,744,520; 5,763,133; 5,766,818; 5,747,215; 5,827,633; 5,853,944; 5,804,349; 5,840,462; 5,869,215; 5,869,215; 5,863,698; 5,902,710; 5,910,387; 5,916,725; 5,919,595; 5,925,488; 5,977,210; 5,994,020; 6,020,101; 6,130,021; 6,120,967 and 6,628,102

Melt blending/extrusion processes for the preparation of toners are illustrated in a number of patents, such as U.S. Pat. Nos. 4,222,982 and 4,233,388 illustrate the formation of toners by melt extrusion; U.S. Pat. No. 2,470,001 discloses the use of an extruder as a mechanism for blending and working two ingredients; and Canadian Patent 1,183,033 relates to the preparation of toners wherein, for example, two incompatible resins are melt blended, and wherein one resin forms a discontinuous phase with the other, the disclosures of which are incorporated herein by reference in their entirety.

According to various embodiments, there is a toner made by the disclosed method of forming a toner as shown in FIG. 1. The toner can include a major amount of resin, a minor amount of one or more colorants and an optional minor amount of one or more of charge additives and surface additives. As used herein, the term "major amount" is understood to mean an amount greater than or equal to about 50 weight percent relative to the total weight of the toner composition. Moreover, as used herein, the term "minor amount" is understood to mean an amount less than about 50 weight percent relative to the total weight of the toner composition. In some embodiments, the resin can be present in an amount of from about 60 to about 99 weight percent of the total weight of the toner composition. In other embodiments, the colorants can be present in an amount of from about 1 to about 10 weight percent of the total weight of the toner composition. In still other embodiments, the optional one or more charge additives and surface additives can be present in an amount of from about 0.1 to about 5.0 weight percent of the total weight of the toner composition.

Any suitable resin can be mixed with the colorant. Examples of suitable resins which can be used include but are not limited to polyamides, epoxies, diolefins, polyesters, polyurethanes, vinyl resins, and polymeric esterification products of a dicarboxylic acid and a diol including a diphenol. Any suitable vinyl resin can be selected for the toner resins of the present application, including homopolymers or copolymers of two or more vinyl monomers. Typical vinyl monomeric units include: styrene, p-chlorostyrene, vinyl naphthalene, unsaturated mono-olefins such as ethylene, propylene, butylene, and isobutylene; vinyl halides such as vinyl chloride, vinyl bromide, vinyl fluoride, vinyl acetate, vinyl propionate, vinyl benzoate, vinyl butyrate, and the like; vinyl esters such as esters of monocarboxylic acids including methyl acrylate, dodecyl acrylate, n-octyl acrylate, 2-chloroethyl acrylate, phenyl acrylate, methylalphachloroacrylate, methyl methacrylate, ethyl methacrylate, and butyl methacrylate; acrylonitrile, methacrylonitrile, acrylimide; vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl indole, N-vinyl pyrrolidene and the like; styrene butadiene copolymers, Pliolites®, available from Eliokem, Inc. (Akron, Ohio), and mixtures thereof.

The toner can also include known charge additives in effective suitable amounts, such as quaternary ammonium compounds, alkyl pyridinium halides, bisulfates, the charge control additives of U.S. Pat. Nos. 3,944,493; 4,007,293; 4,079,014; 4,298,672; 4,394,430; and 4,560,635, the disclosures of which are incorporated herein by reference in their entirety, negative charge enhancing additives like aluminum complexes, other known charge additives, and the like.

Surface additives include but are not limited to stabilizers, waxes, flow agents, other toners and charge control additives. Specific additives suitable for use in toners include, but not limited to metal salts, metal salts of fatty acids, colloidal silicas, metal oxides, strontium titanates, silicon derivatives such as ΔEROSIL® R972, available from Degussa, Inc. (Parsippany, N.J.), ferric oxide, hydroxy terminated polyethylenes such as Unilin®, polyolefin waxes, which preferably are low molecular weight materials, including those with a molecular weight of from about 1,000 to about 20,000, and including polyethylenes and polypropylenes, polymethylmethacrylate, zinc stearate, chromium oxide, aluminum oxide, titanium oxide, stearic acid, and polyvinylidene fluorides such as Kynar®, mixtures thereof, and additives of U.S. Pat. Nos. 3,590,000; 3,720,617; 3,655,374 and 3,983,045, the disclosures of which are incorporated herein by reference in their entirety. The coated silicas of U.S. Pat. No. 6,190,815 and U.S. Pat. No. 6,004,714, the disclosures of which are incorporated herein by reference in their entirety. For proper attachment and functionality, typical additive particle sizes can range from about 5 nanometers to about 50 nanometers. Some newer toners can require a greater number of additive particles than prior toners as well as a greater proportion of additives in the about 25-50 nanometer range.

Developer compositions can be prepared by mixing the toners obtained with the processes disclosed herein with known carrier particles, including coated carriers, such as steel, ferrites, and the like, reference U.S. Pat. Nos. 4,937,166 and 4,935,326, the disclosures of which are incorporated herein by reference in their entirety, for example from about 2 percent toner concentration to about 8 percent toner concentration. The carrier particles can also be comprised of a core with a polymer coating thereover, such as polymethylmethacrylate (PMMA), having dispersed therein a conductive component like conductive carbon black. Carrier coatings include silicone resins, fluoropolymers, mixtures of resins not in close proximity in the triboelectric series, thermosetting resins, and other known components.

Figure 2:
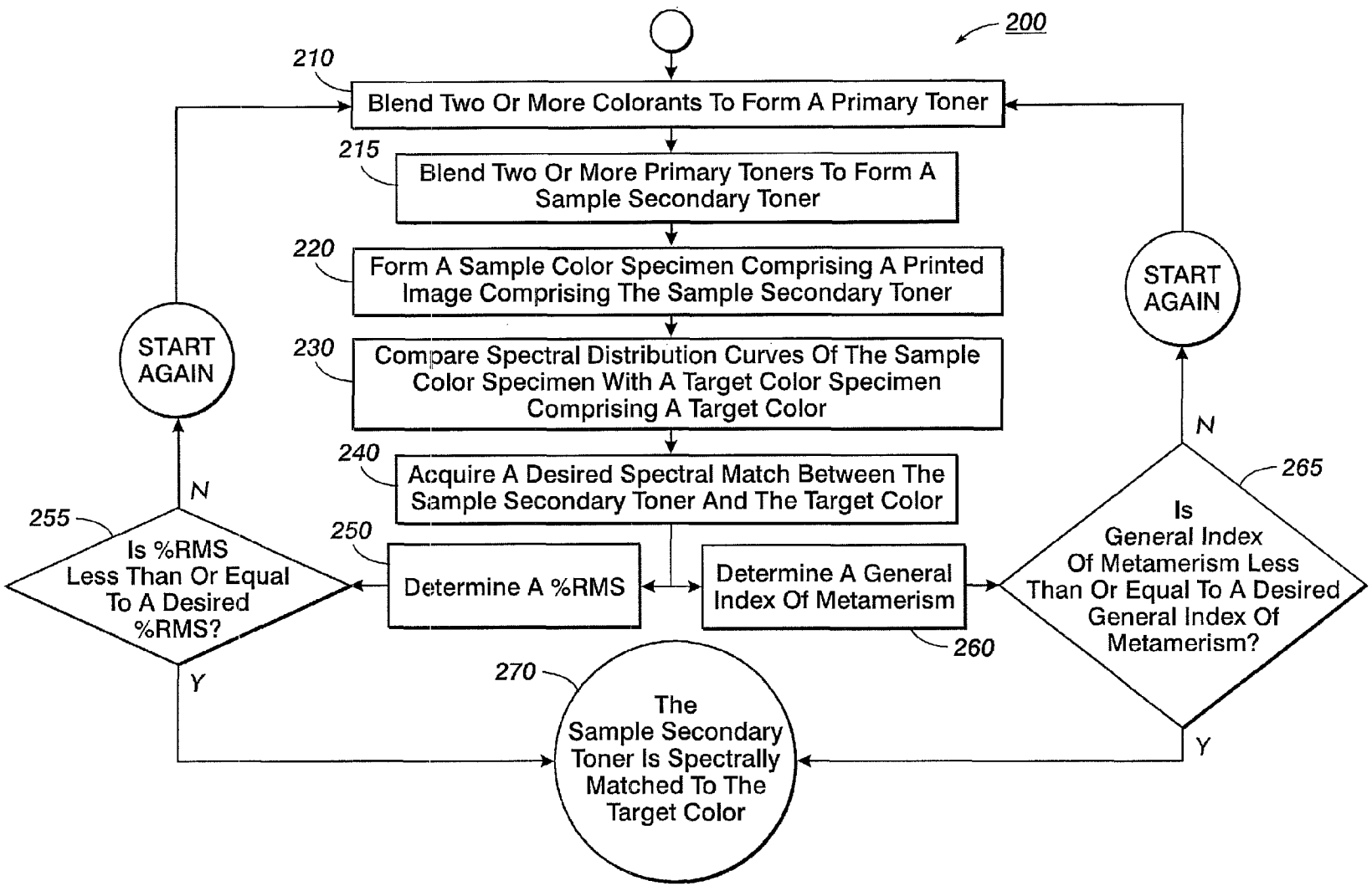
FIG. 2 depicts a flow chart of another exemplary method of forming a toner, according to various embodiments of the present teachings.
Figure 3:
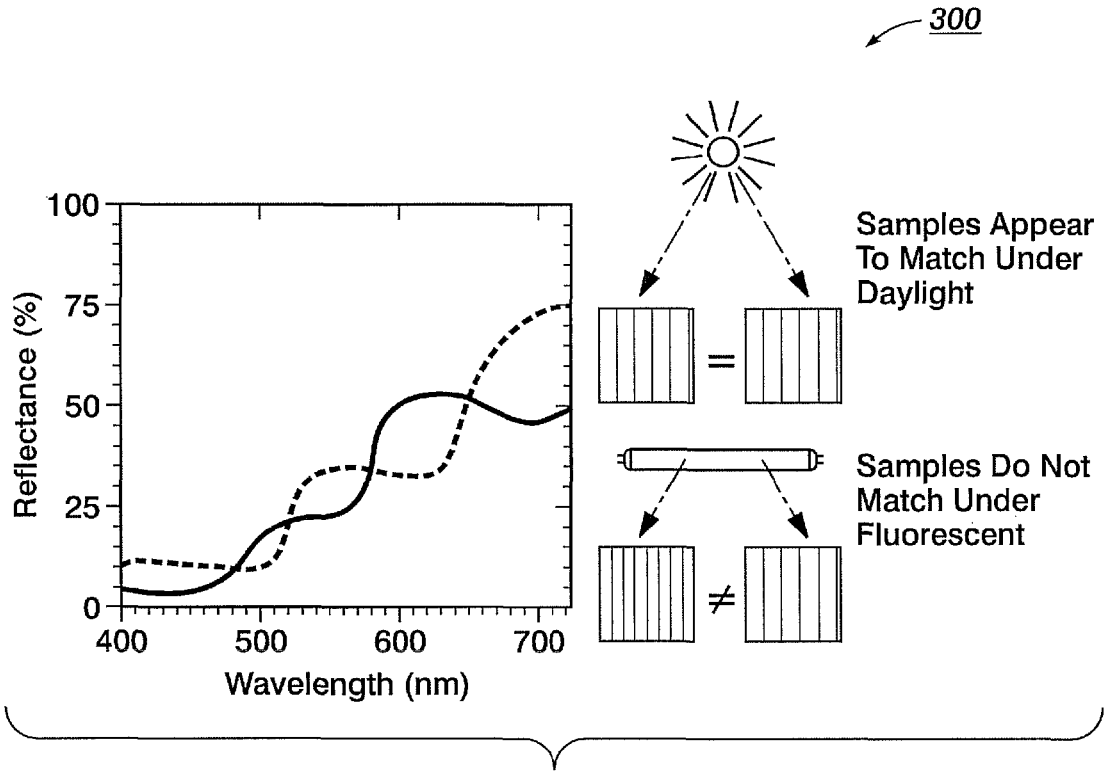
FIG. 3 shows exemplary reflectance curves of a metameric pair.

According to various embodiments of the present teachings, there is a method of forming a toner as shown in FIG. 2. The method 200 as shown in FIG. 2 can include blending two or more colorants to form a primary toner as in 210, blending two or more primary toners to form a sample secondary toner as in 215, and forming a sample color specimen including a printed image including the sample secondary toner as shown in 220. The method 200 of forming a toner can further include comparing spectral distribution curves of the sample color specimen with that of a target color specimen including a target color as shown in 230 and acquiring a desired spectral match between the sample secondary toner and the target color as shown in 240. In various embodiments, the step of acquiring a desired spectral match between the sample secondary toner and the target color as in 240 can include determining a desired % root mean square difference in the spectral distribution curves of the sample color specimen and the target color specimen as in 250. In other embodiments, the step 240 of acquiring a desired spectral match the sample secondary toner and the target color can include determining a desired value of general index of metamerism in terms of color difference in the spectral distribution curves of the primary color specimen and the standard color specimen as in 260. In some embodiments, if the determined % RMS and/or determined GMI are less than or equal to the desired % RMS and desired GMI as in 255, 265, then the sample secondary toner can be spectrally matched to the target color as in 270 and if not, then all the steps 210, 215, 220, 230, 240, 250, 255, 260, 265 can be repeated until a spectral match can be found as in 270.

According to various embodiments, there is a method of forming an image. The method can include providing an imaging station for forming a latent image on an electrophotographic photoreceptor, providing a development subsystem including a set of toners for converting the latent image to a visible image on the electrophotographic photoreceptor, and providing a transfer station for transferring and fixing the visible image onto a media, wherein the one or more toners of the set of toners has a spectral match to one or more desired target colors. In various embodiments, the set of toners can include one or more primary toners and secondary toners. In some embodiments, the desired target colors can include one or more colorants of an offset printing, a lithography, a flexography, an inkjet printing, and a dry ink xerographic process. In some other embodiments, the desired standards can include one or more Pantone color standards including one or more Pantone primary colors.

According to various embodiments, there is a printing machine including a developer housing and a latent image receiving member adapted for developing a set of toners to form color images, and wherein one or more toners of the set of toners has a spectral match to one or more desired target colors. In various embodiments, the set of toners can include one or more primary toners and secondary toners. In some embodiments, the desired target colors can include one or more colorants of offset printing, a lithography, a flexography, an inkjet printing, and a dry ink xerographic process. In other embodiments, the desired target colors can include one or more Pantone color standards including one or more Pantone primary colors.

EXAMPLE

Preparation of a Sodio Sulfonated Polyester

A linear sulfonated random copolyester resin including about 0.465 mol percent of terephthalate, about 0.0375 mol percent of sodium sulfoisophthalate, about 0.475 mol percent of 1,2-propanediol, and about 0.025 mol percent of diethylene glycol was prepared as follows:

About 3.98 kilograms of dimethylterephthalate, about 451 grams of sodium dimethyl sulfoisophthalate, about 3.104 kilograms of 1,2-propanediol (1 mole excess of glycol), about 351 grams of diethylene glycol (1 mole excess of glycol), and about 8 grams of butyltin hydroxide oxide catalyst were charged in a 5 gallon Parr reactor equipped with a bottom drain valve, a double turbine agitator, and a distillation receiver with a cold water condenser. The reactor was then heated to about 165° C. with stirring for about 3 hours whereby about 1.33 kilograms of distillate was collected in the distillation receiver. The distillate included about 98 percent by volume of methanol and about 2 percent by volume of 1,2-propanediol as measured by the ABBE refractometer available from American Optical Corporation (Southbridge, Mass.). The reactor mixture was then heated to about 190° C. over about one hour period, after which the pressure was slowly reduced from atmospheric pressure to about 260 Torr over about one hour period, and then reduced to about 5 Torr over about two hour period with the collection of about 470 grams of distillate in the distillation receiver. The distillate included about 97 percent by volume of 1,2-propanediol and about 3 percent by volume of methanol as measured by the ABBE refractometer. The pressure was then further reduced to about 1 Torr over about 30 minute period whereby an additional about 530 grams of 1,2-propanediol was collected. The reactor was then purged with nitrogen to atmospheric pressure, and the polymer product was discharged through the bottom drain onto a container cooled with dry ice to yield about 5.60 kilograms of about 3.5 mol percent sulfonated polyester resin, sodio salt of (1,2-propylene-dipropylene-5-sulfoisophthalate)-copoly(1,2-propylene-dipropylene terephthalate). The glass transition temperature of the sulfonated polyester resin was measured to be about 57.2° C. (onset) utilizing the 910 Differential Scanning Calorimeter available from E.I. DuPont (Wilmington, Del.) operating at a heating rate of about 10° C./minute. The number average molecular weight was measured to be about 3,250 grams per mole, and the weight average molecular weight was measured to be about 9,400 grams per mole using tetrahydrofuran as the solvent.

Preparation of a Sodio Sulfonated Polyester Colloidal Solution

A 22 weight percent sodio sulfonated polyester colloidal solution was prepared by first heating about 2 liters of deionized water to about 85° C. and adding thereto 440 grams of the sulfonated polyester resin obtained above with stirring, followed by continued heating at about 85° C. and stirring of the mixture for about one to about two hours, followed by cooling to about room temperature, i.e. about 25° C. The colloidal solution of sodio-sulfonated polyester resin particles possessed a characteristic blue tinge, with particle sizes in the range of about 5 to about 150 nanometers, and typically in the range of about 20 to about 40 nanometers, as measured by the NiCOMP® particle sizer available from PSS (Santa Barbara, Calif.).

Preparation of Yellow Toner

About 833 grams of about 22 weight percent sodio sulfonated polyester colloidal solution was charged into a 2 liter kettle equipped with a mechanical stirrer. To this solution was added about 100 grams of a yellow pigment dispersion containing about 15.9 wt. % of PY74 (available from Sun Chemicals, Parsippany, N.J.) and about 9.3 grams of a yellow pigment dispersion containing about 42.9 wt. % of PY14 (available from Sun Chemicals, Parsippany, N.J.). The resulting mixture was heated to about 56° C. with stirring at about 180 to about 200 revolutions per minute. To this heated mixture, about 720 grams of an aqueous solution containing about 3 wt. % of zinc acetate dehydrate was added dropwise. The dropwise addition of the zinc acetate dihydrate solution was accomplished utilizing a peristaltic pump, over a period of about 40 minutes. After the addition was complete, the mixture was heated to a temperature of about 68° C. A sample (about 1 gram) of the reaction mixture was then retrieved from the kettle, and a particle size of about 8.3 microns with a GSD of about 1.16 was measured by the Coulter Counter. The mixture was then allowed to cool to room temperature, about 25° C. The product was filtered off through a 3 micron hydrophobic membrane cloth, and the toner cake was reslurried into about 2 liters of deionized water and stirred for about 1 hour. This process was repeated 3 times and then the toner slurry was dried to obtain about 8.3 micron sized yellow toner including a linear sulfonated polyester resin, pigment PY75 and pigment PY14. The yellow toner spectrally matched a Pantone Yellow, a Pantone Primary with a color difference, $\Delta E$ of about 0.60 and general index of metamerism of about 0.63.

While the invention has been illustrated with respect to one or more implementations, alterations and/or modifications can be made to the illustrated examples without departing from the spirit and scope of the appended claims. In addition, while a particular feature of the invention may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising."

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A method of matching a toner to a target color of a different color system comprising:

(a) forming a sample toner comprising one or more primary toners by blending two or more colorants;

(b) forming a sample color specimen comprising a printed image comprising the sample toner;

(c) measuring a spectral distribution curve for the sample color specimen and comparing it to the spectral distribution curve for a specimen of the target color, wherein the target color specimen comprises a different primary toner than the sample toner and is printed and determining a % root mean square difference between the spectral distribution curves, a color difference value ΔE between the sample color specimen and the target color specimen, and a general index of metamerism (GMI); and (d) repeating steps a-c until the % root mean square difference is about 12% or less and until the GMI is less than about four.

2. The method of claim 1, further comprising blending two or more primary toners to form a sample secondary toner.

3. The method of claim 1, wherein the step of forming a sample toner comprises blending two or more primary toners.

4. The method of claim 1, wherein the % root mean square difference between the spectral distribution curves of the sample color specimen and the target color specimen is less than or equal to about 2%.

5. A method of matching a toner to a target color of a different color system comprising:

(a) forming a sample toner comprising one or more primary toners by blending two or more colorants;

(b) forming a sample color specimen comprising a printed image comprising the sample toner;

(c) measuring a spectral distribution curve for the sample color specimen and comparing it to the spectral distribution curve for a specimen of the target color, wherein the target color specimen comprises a different primary toner than the sample toner and is printed and determining a color difference value ΔE between the sample color specimen and the target color specimen and a general index of metamerism (GMI); and (d) repeating steps a-c until the GMI is about 4 or less.

6. The method of claim 5, comprising repeating steps a-c until the general index of metamerism (GMI) is less than about 1.

7. The method of claim 1, wherein the general index of metamerism (GMI) is determined by a method comprising illuminating the sample color specimen and the target color specimen with a reference illuminant and a test illuminant.

8. The method of claim 7, wherein the reference illuminant comprises a CIE $D_{65}$ illuminant having a correlated color temperature of 6500 K.

9. The method of claim 7, wherein the test illuminant comprises an Illuminant A having a profile of a black body radiator at 2856 K.

10. The method of claim 1, further comprising selecting one or more colorants from one or more pigments, dyes, and mixture of pigments and dyes.

11. The method of claim 1, further comprising selecting one or more colorants from a yellow pigment, an orange pigment, a red pigment, a magenta pigment, a purple pigment, a blue pigment, a cyan pigment, a green pigment, and a black pigment.

12. The method of claim 1, wherein each of the one or more primary toners comprises at least one of Yellow, Orange, Warm Red, Red 032, Rubin Red, Rhodamine Red, Purple, Violet, Blue 72, Reflex Blue, Process Blue, Green toner, and combinations thereof.

13. The method of claim 1, wherein the target color specimen comprises a Pantone color standard comprising one or more Pantone primary colorants.

14. The method of claim 1, wherein the target color specimen comprises one or more colorants of an offset printing, a lithography, a flexography, an inkjet printing, and a dry ink xerographic process.

15. The method of claim 1, wherein the step of forming a sample toner further comprises adding one or more of a resin, charge additives, and surface additives.

16. The method of claim 1, further comprising repeating steps a-c until the general index of metamerism (GMI) is about one or less.

17. The method of claim 5, further comprising blending two or more primary toners to form a sample secondary toner.

18. The method of claim 5, wherein the general index of metamerism (GMI) is determined by a method comprising illuminating the sample color specimen and the target color specimen with a reference illuminant and a test illuminant, wherein the reference illuminant comprises a CIE $D_{65}$ illuminant having a correlated color temperature of 6500 K, and wherein the test illuminant comprises an Illuminant A having a profile of a black body radiator at 2856 K.

19. The method of claim 5, further comprising selecting one or more colorants from one or more pigments, dyes, and mixtures of pigments and dyes, wherein the pigments comprise a yellow pigment, an orange pigment, a red pigment, a magenta pigment, a purple pigment, a blue pigment, a cyan pigment, a green pigment, or a black pigment.

20. The method of claim 5, wherein each of the one or more primary toners comprises at least one of Yellow, Orange, Warm Red, Red 032, Rubin Red, Rhodamin Red, Purple, Violet, Blue 72, Reflex Blue, Process Blue, Green toner, and combinations thereof.

21. The method of claim 5, wherein the target color specimen comprises a Pantone color standard comprising one or more Pantone primary colorants.

22. The method of claim 5, wherein the target color specimen comprises one or more colorants of an offset printing, a lithography, a flexography, an inkjet printing, and a dry ink xerographic process.

23. The method of claim 5, repeating steps a-c until the % root mean square difference is about 12% or less.

24. A method of matching a toner to a target color of a different color comprising:

(a) forming a sample toner comprising one or more primary toners by blending two or more of a yellow pigment, an orange pigment, a red pigment, a magenta pigment, a purple pigment, a blue pigment, a cyan pigment, a green pigment, and a black pigment;

(b) forming a sample color specimen comprising a printed image comprising the sample toner;

(c) measuring a spectral distribution curve for the sample color specimen and comparing it to the spectral distribution curve for a specimen of the target color, wherein the target color specimen is printed and comprises a Pantone color standard comprising one or more Pantone primary colorants and comprises a different primary toner than the sample toner and;

(d) determining a % root mean square difference between the spectral distribution curves, a color difference value ΔE between the sample color specimen and the target color specimen, and a general index of metamerism (GMI); and (e) repeating steps ac until the % root mean square difference is less than or equal to about 2% and until the GMI is less than about 1.

* * * * *